US008850988B2

(12) United States Patent
Creissels et al.

(10) Patent No.: US 8,850,988 B2
(45) Date of Patent: Oct. 7, 2014

(54) INSTALLATION WITH OVERHEAD CABLES AND VEHICLES SERVED THEREBY, WITHOUT HANGER

(75) Inventors: Denis Creissels, Meylan (FR); Jerome Richard, Crolles (FR)

(73) Assignee: Creissels Technologies, Meylan (FR)

( * ) Notice: Subject to any disclaimer, the term of this patent is extended or adjusted under 35 U.S.C. 154(b) by 164 days.

(21) Appl. No.: 13/806,449

(22) PCT Filed: Jun. 21, 2011

(86) PCT No.: PCT/FR2011/000353

§ 371 (c)(1),
(2), (4) Date: Dec. 21, 2012

(87) PCT Pub. No.: WO2011/161333

PCT Pub. Date: Dec. 29, 2011

(65) Prior Publication Data

US 2013/0098260 A1 Apr. 25, 2013

(30) Foreign Application Priority Data

| | | |
|---|---|---|
| Jun. 23, 2010 | (FR) | 10 02635 |
| Jul. 22, 2010 | (FR) | 10 03078 |
| Aug. 26, 2010 | (FR) | 10 03454 |
| Dec. 27, 2010 | (FR) | 10 05129 |

(51) Int. Cl.

| | |
|---|---|
| ***B61B 7/02*** | (2006.01) |
| ***B61B 7/06*** | (2006.01) |
| ***B61B 7/00*** | (2006.01) |

(52) U.S. Cl.
CPC ... *B61B 7/02* (2013.01); *B61B 7/06* (2013.01); *B61B 7/00* (2013.01)
USPC ..... 104/112; 104/87

(58) Field of Classification Search
CPC ..... B61B 7/00; B61B 7/02; B61B 7/06
USPC ..... 104/87, 112, 115
See application file for complete search history.

(56) References Cited

U.S. PATENT DOCUMENTS

| | | | | | |
|---|---|---|---|---|---|
| 328,899 | A | * | 10/1885 | Morrison | 104/123 |
| 3,702,124 | A | * | 11/1972 | Highland | 182/14 |
| 4,163,480 | A | * | 8/1979 | Highland | 182/14 |
| 4,280,411 | A | * | 7/1981 | Katayose et al. | 104/112 |
| 4,327,646 | A | * | 5/1982 | Nakata et al. | 104/89 |
| 4,473,011 | A | * | 9/1984 | Wuschek | 104/173.1 |
| 4,641,587 | A | | 2/1987 | Dalliard | |
| 4,691,642 | A | * | 9/1987 | Creissels | 104/173.1 |
| 7,624,684 | B2 | * | 12/2009 | Morris | 104/112 |
| 2009/0038499 | A1 | | 2/2009 | Morris | |

FOREIGN PATENT DOCUMENTS

| | | | | |
|---|---|---|---|---|
| EP | 0 561 095 | A2 | 9/1993 | |
| EP | 561095 | A2 * | 9/1993 | B61B 7/06 |
| FR | 2 575 985 | A1 | 7/1986 | |
| FR | 2575985 | A1 * | 7/1986 | B61B 7/02 |

* cited by examiner

*Primary Examiner* — Zachary Kuhfuss
(74) *Attorney, Agent, or Firm* — Oliff PLC

(57) ABSTRACT

An overhead installation for transporting people in an urban environment includes two carrying cables, which sag in curved manner and are spaced apart from one another, on which the rollers of the vehicle without a hanger arm run. Jacks with vertical displacement, controlled by a central unit, are placed in the connection between the rollers and the vehicle so as to reduce transmission of undesirable movements, resulting from the sag of the cables, to the car of the vehicle.

14 Claims, 6 Drawing Sheets

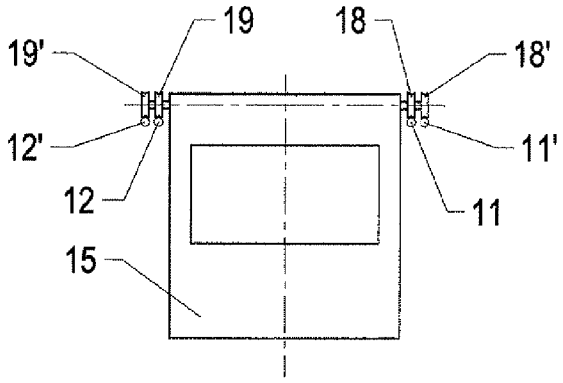
fig.20
fig.21
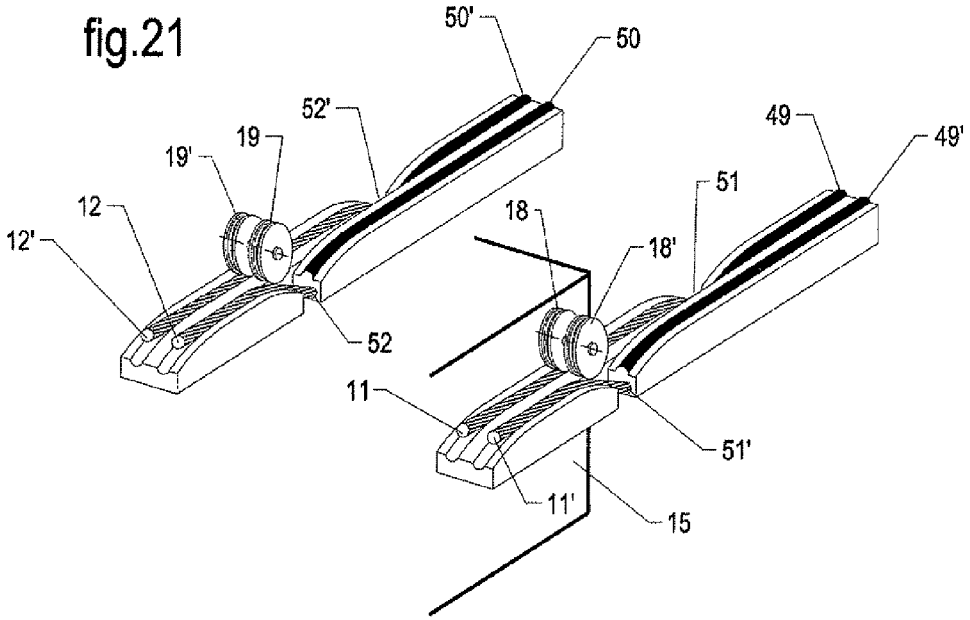
fig.22
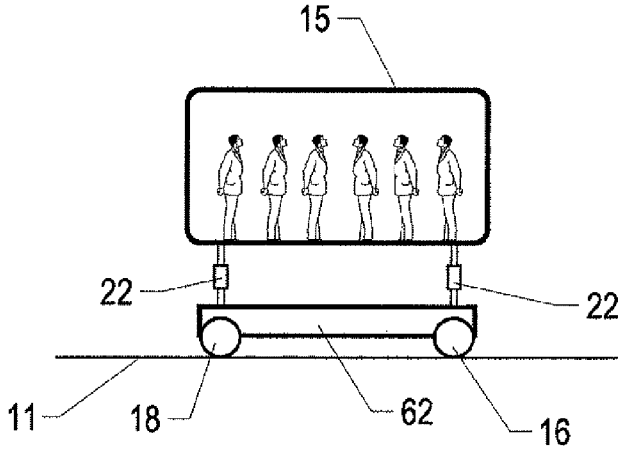

INSTALLATION WITH OVERHEAD CABLES AND VEHICLES SERVED THEREBY, WITHOUT HANGER

BACKGROUND OF THE INVENTION

The invention relates to an overhead installation for transporting people, comprising two overhead carrying cables which are spaced apart from one another and extend in parallel manner on the same level, being stretched taut between two pillars to form a curved running track presenting a deformable sag, and a positively guided, servo-controlled vehicle comprising a passenger compartment, four rollers arranged in the form of a rectangle, with two rollers longitudinally spaced apart from one another running on one of the cables, and two rollers longitudinally spaced apart from one another running on the other cable, to support and guide the passenger compartment of the vehicle running on the curved track, and a connecting device without a hanger arm between the rollers and the passenger compartment to position the passenger compartment longitudinally, transversely, and with respect to the level.

The expression positively guided, servo-controlled means a certain guiding, without the risk of random movements, and in the telfer car technique more particularly a vehicle without a hanger arm. The invention relates to an installation having a vehicle without a hanger arm, i.e. a vehicle not making use of gravity to maintain its verticality, which runs on carrying cables presenting sags.

STATE OF THE ART

Overhead cable installations, in particular telfer cars, are generally located in mountainous areas and comprise vehicles equipped with articulated hanger arms which are more or less long according to the slope of the cables and to the length of the cars. The infrastructure of these telfer cars is of considerable size and the car is subjected, in the course of movement, to rocking movements and random rocking which make the use of such telfer cars in an urban environment quite unacceptable.

The document FR2,575,985 describes an installation with two carrying cables on which four rollers run, the spindles of the rollers being rigidly fixed to the four corners of the vehicle. The vehicle is positively guided, in the acceptance of the term in the present description, but the vehicle follows the curved sagging path of the cables with inclines that are unacceptable for an urban people mover.

The documents EP0,561,095 and U.S. Pat. No. 4,641,587 concern overhead vehicles suspended on two carrying cables by hanger arm systems. The carrying cables are kept horizontal, in the manner of suspended bridges, by a sizeable infrastructure. It is moreover almost impossible to achieve horizontal tracks with cables. According to the present invention, the carrying cables are simply stretched taut between pillars of smaller height as the vehicle does not have a hanger arm.

The document US2009/0038499 describes a vehicle having a hanger arm which is formed by cables. The carriage runs on a carrying cable which sags in curved manner and the car is not positively guided, according to the meaning of the present invention, as it is subjected to longitudinal and transverse rocking and swaying movements, unacceptable for an urban people mover.

OBJECT OF THE INVENTION

The object of the present invention is to enable an overhead installation to be provided, meeting the current requirements of a transport system in an urban environment, in particular movement at high speed, maximum passenger comfort and a light infrastructure. The cabin of the vehicle must not be subjected to any undesirable movement detrimental to the comfort of the passengers, in spite of the sag of the cables. An undesirable movement can be a rocking movement, a variation of level, a vertical acceleration or jerking when passing over a discontinuity of the track.

In one embodiment, the car or passenger compartment is kept vertical or very slightly inclined whatever the slope, in the longitudinal direction, of the cables on which the rollers run, and whatever the difference of level of the cables in the transverse direction, in particular due to decentring of the transported load and/or the action of a side wind. The term vertical implies a horizontal floor of the car, and the terms vertical and horizontal will henceforth be used indifferently to designate the position of the car.

According to other implementations of the invention, the car remains at a constant level, jerking is attenuated and the vertical acceleration when passing over the cable support structures is reduced to within acceptable comfort limits.

The installation according to the invention is characterized in that the four rollers follow the height variations of the cable in space independently, during movement of the vehicle, that said connecting device comprises an individual positive height-adjustable jack for each roller, and that the vehicle comprises a central unit which controls the different individual jacks so as to compensate the height variations of the different rollers, imposed by the cables, during movement on the curved track.

The expression 'positive height-adjustable jack' means that the device transmits the movements faithfully, in servo-controlled manner, with a single height adjustment possibility.

In one embodiment of the invention, the central unit is controlled by a detector of the incline of the passenger compartment so as to move the different rollers in the heightwise direction to keep the passenger compartment vertical.

The central unit can also be controlled by a level detector to keep the level of the passenger compartment constant along the whole itinerary and/or by a vertical acceleration detector, in particular when passing over a pillar.

According to an important development of the invention, the vehicle runs on the carrying cables, its centre of gravity being located above the cables. The infrastructures (pillars and terminals supporting the carrying cables) are thus less high than the value of the height of the car and of the hanger arm compared with the usual installation where the vehicle is suspended on the cables, which is appreciable in terms of insertion in an urban environment, and very economical as far as the cost of said infrastructures is concerned. All the mechanical parts and the accessories of the vehicle can be grouped together underneath the cabin. In the case of traction by a cable, advantageously situated underneath the level of the car, the cable can naturally escape downwards, which has the consequence of only requiring support rollers (to the exclusion of compression rollers, passage of which under the vehicle would give rise to problems, in the same way as passage of the support rollers gives rise to problems for suspended vehicles).

When the track presents a break of continuity, in particular when passing from cables to rails, an undesirable movement of the passenger compartment is inevitable. In one embodiment, each carrying cable is replaced by a pair of juxtaposed cables and each roller is replaced by a pair of rollers, juxtaposed on one and the same spindle, running on the pair of juxtaposed cables. The cable-rail transitions are staggered longitudinally from one cable to the other so that carrying is always performed by one of the cables of the pair and by the associated roller preventing any jerking when passage takes place. Redundancy of the cables and rollers reduces the risks of accidents, one taking over from the other in case of an incident occurring on a roller or on a carrying cable.

The vehicle can comprise one or more electric motors (not shown) driving one or more rollers enabling it to be self-driven. When the vehicle is hauled by a hauling cable, the motor takes over when the vehicle is detached from the hauling cable. When this hauling cable is below the running level of the vehicle, the coupling clamp is retractable so that no element of the vehicle is underneath the level of the running rollers to ensure freedom of running of the vehicle in the terminal stations.

BRIEF DESCRIPTION OF THE DRAWINGS

Other advantages and features of the invention will become more clearly apparent from the following description of different embodiments of the invention, given for non-restrictive example purposes only and represented in the appended drawings, in which:

FIG. 20 is a similar view to FIG. 4 of an improvement of the invention;

FIG. 21 is a partial perspective view of the vehicle according to FIG. 20 illustrating passage over a break of continuity of the track;

FIG. 22 is a schematic front view of a vehicle according to an alternative embodiment of the invention;

The same reference numerals are used in the different figures to designate similar or identical parts.

DETAILED DESCRIPTION OF THE INVENTION

Figure 1:
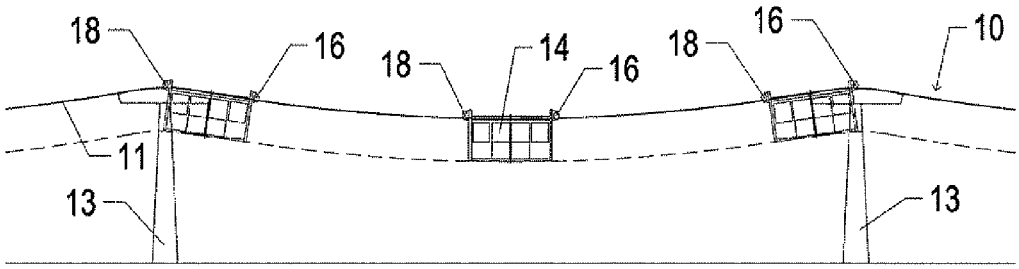
FIGS. 1 and 2 are elevational views of a section of an installation, respectively illustrating passage of a vehicle without a trim corrector and passage of a vehicle with trim correction.
Figure 2:
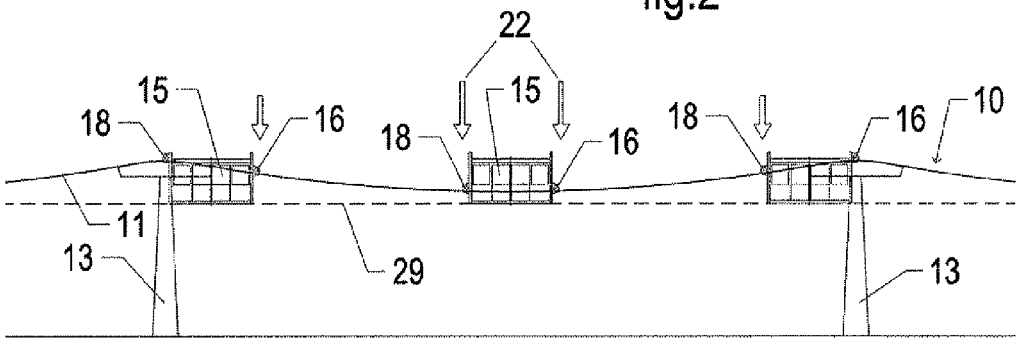
Figure 6:
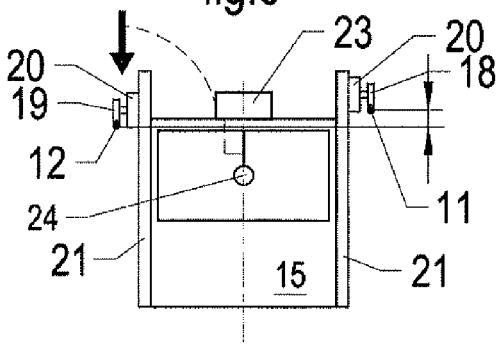

In FIGS. 1 and 2, an overhead track 10 of an urban transport installation comprises two carrying cables 11,12 stretched taut between pillars 13, and vehicles 14,15 of almost rectangular shape having a roller 16-19 at each of their four corners for running on cables 11,12, one pair of rollers 16,17 at the front and one pair of rollers 18,19 at the rear. Each roller 16-19 is supported by a slide block 20 (FIG. 6) movable in a vertical slide guide 21 fixed over the whole height of vehicle 15. Each roller 16-19 has associated therewith a jack 22 (represented schematically by an arrow) for heightwise movement, and all the jacks 22 are connected to a central unit of a trim corrector 23 receiving information from an inclinometer 24 schematically represented by a pendulum.

Operation is clearly apparent from FIGS. 1 and 2. In FIG. 1, vehicle 14 does not comprise a trim corrector and rollers 16-19 are rigidly fixed to the vehicle. Between the two pillars 13, the vehicle follows the sagging trajectory of cables 11,12, rocking towards the front and then towards the rear, which is not acceptable.

According to the invention, represented in FIG. 2, pendulum 24 detects the frontwards rocking of vehicle 15 and sends a movement order of the front rollers 16,17 in the downwards direction to compensate the descending slope of cables 11,12. Subsequently a relative displacement of front rollers 16,17 with respect to rear rollers 18,19 enables vehicle 15 to be kept substantially vertical, compensating the longitudinal rocking corresponding to the sag of the cables. Floor 25 remains horizontal throughout the travel between the two pillars. In the example represented in FIG. 2, floor 25 also remains at a constant level, in the manner described in greater detail with reference to FIGS. 7 to 9.

Figure 5:
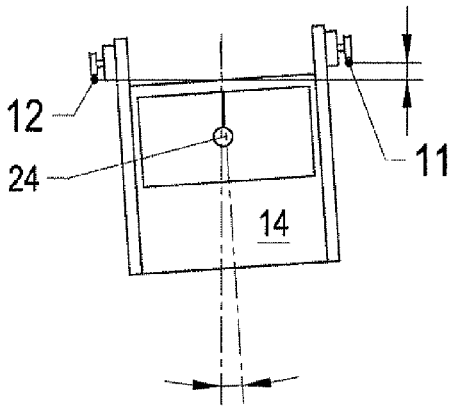
FIGS. 5 and 6 are side views of the vehicle illustrating correction of a transverse incline.

The device with individual displacement of rollers 16-19 also enables transverse rocking of the vehicle, in particular due to a difference of level of cables 11,12, to be compensated. FIG. 5 represents such a rocking, in the absence of correction, the passengers having for example gathered in a group on the left side of vehicle 14. Pendulum 24 detects this transverse rocking and transmits to trim corrector 23 a movement order of left-hand rollers 17,19 downwards to re-establish the vertical position of vehicle 15, represented in FIG. 6.

According to an important development of the invention, the device with independent rollers 16-19 ensures a straight trajectory 29 of vehicle 15, at a constant level, in spite of a notable sag of the track constituted by cables 11,12. In FIG. 2, a detector (not shown), measuring for example the level of vehicle 15 with respect to the ground, controls downward displacement of the four rollers 16-19 over the descending path to reach the bottom position, on arrival at the bottom of the sag of cables 11,12. On the following, ascending path, rollers 16-19 move up towards the top of the vehicle, and it can be seen that these displacements of rollers 16-19 thus ensure a straight trajectory of the vehicle on a track that undulates heightwise. Throughout its travel, the vehicle is naturally kept horizontal by differential action of the front rollers 16,17 with respect to the rear rollers 18,19 for longitudinal compensation, and of the left-hand rollers 17,19 with respect to the right-hand rollers 16,18 for transverse compensation.

Figure 7:
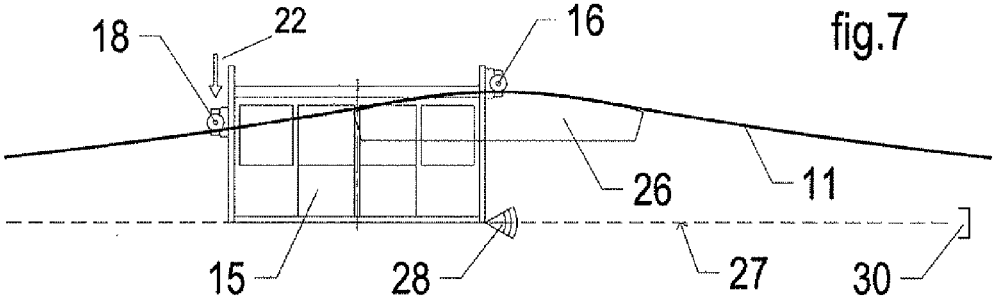
FIGS. 7 to 9 are front views showing the successive positions of the vehicle when passing over a pillar.
Figure 8:
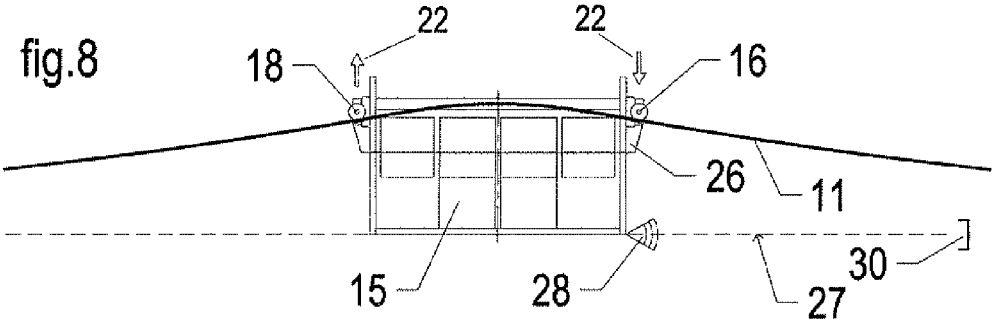
Figure 9:
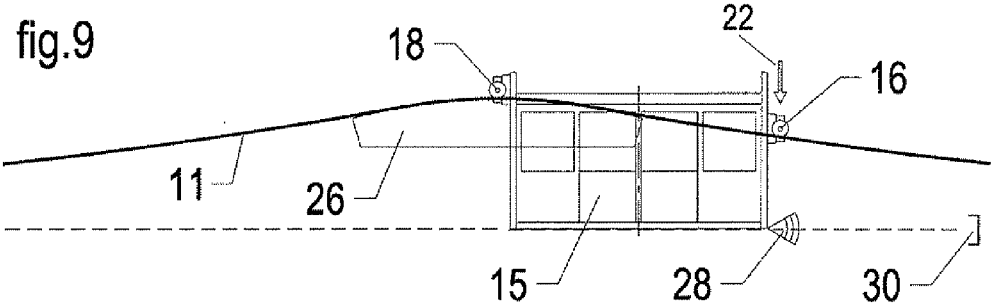

Keeping a straight path 29, in particular when passing over a shoe 26 of a pillar 13, is illustrated in FIGS. 7 to 9. The straight path is materialized by a laser beam 27 sent by an emitter 28, securedly attached to the vehicle, to a fixed landmark 30, for example located on a pillar at the required level. The displacements of rollers 16-19 are controlled by the trim detector with laser beam 27, in the manner schematically represented by the direction of the arrows or jacks 22, and it is needless to describe operation of the latter in detail.

In practice, the trim correctors are more elaborate than those described previously and they can for example comprise electronic systems for foreseeing and regulating displacement of the rollers, or, for a given installation, complete programming of the displacements.

Figure 10:
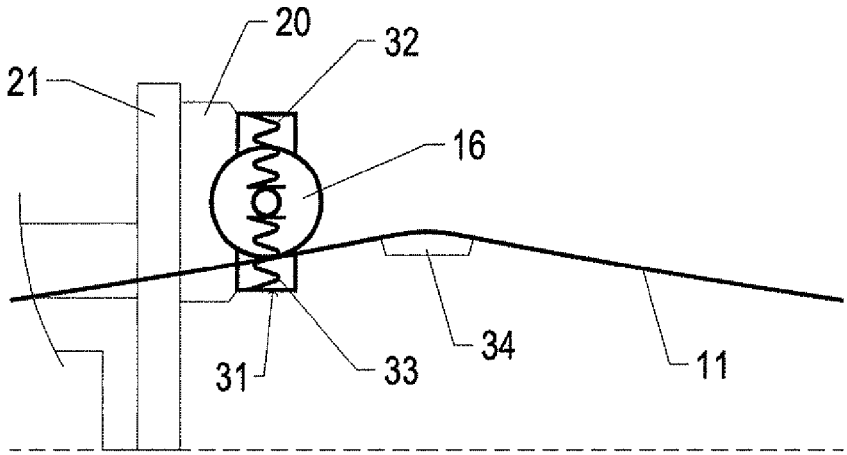
FIGS. 10 to 12 are detailed elevation views of a support damper of a roller, respectively when passing a short support.
Figure 11:
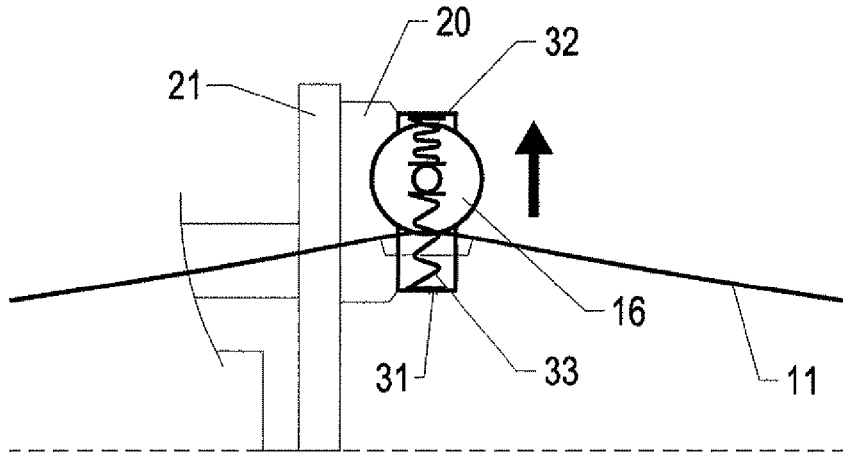
Figure 12:
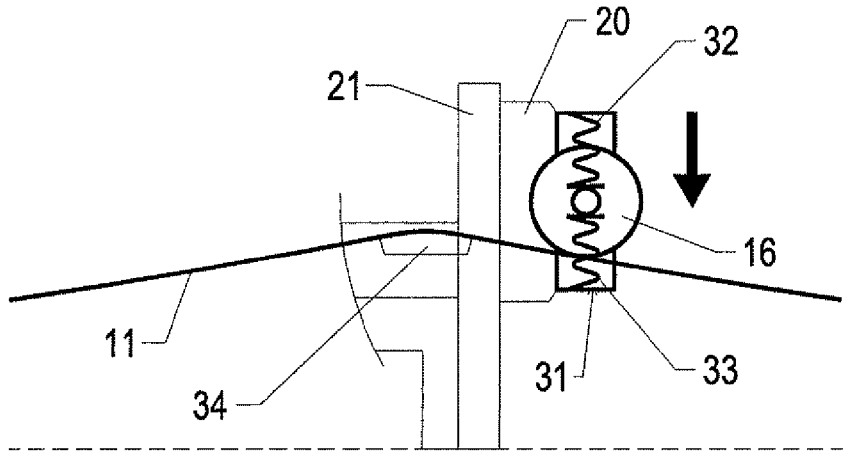

According to another development of the invention, the trim correction system is completed by a device for damping brief and limited variations of the slopes of the track. The fixing system securing each roller 16-19 to its slide block 20 comprises a damper 31, schematically represented in FIGS. 10-12 by a pair of springs 32,33 which urge the roller flexibly to a central position while enabling a limited vertical displacement. When passing over a short support 34 of cable 11 (FIG. 11), the roller compresses damper 31 upwards to absorb the shock without transmitting it to the vehicle. After the passage (FIG. 12), damper 31 returns to the normal position. Such dampers are well known.

Figure 13:
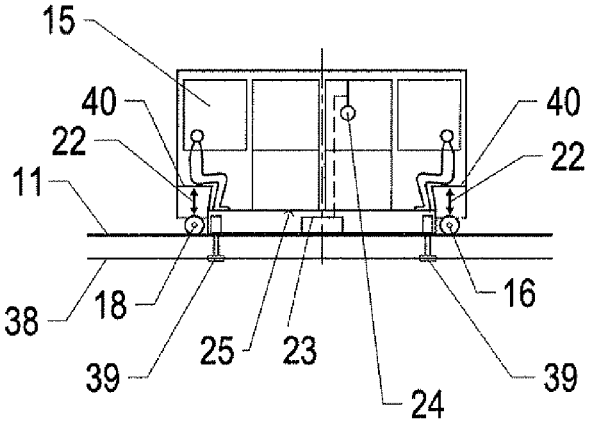
FIGS. 13 and 14 are schematic front and side views of a vehicle according to an alternative embodiment of the invention.
Figure 14:
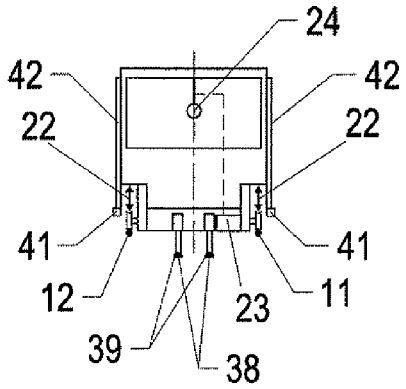

In FIGS. 13 and 14 which illustrate an alternative embodiment, rollers 16-19 are located underneath floor 25 of vehicle 15, at each of the four corners. A jack 22 for performing vertical displacement is associated with each roller 16-19 and all the jacks are connected to central unit 23. Rollers 16-19 are represented in the available space under seats 40 situated at the ends of the car, but if the necessary displacement is greater than this space, rollers 16-19 can advantageously be placed outside the ground occupation space of the car. The traction system of the vehicle, represented here by a hauling cable 38 and coupling clamps 39, can advantageously be situated underneath the floor of the vehicle, the same being the case for central unit 23 or for any other accessory. Doors 42 of the car, being able to be situated on both sides, are guided and controlled from a mechanism 41 also situated underneath the floor. A transverse detector 24 of rocking of the vehicle controls central unit 23, which commands jacks 22 so as to prevent excessive rocking that may cause sideways toppling of the vehicle.

Figure 15:
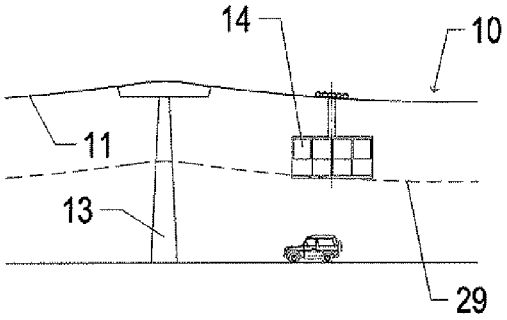
FIGS. 15 and 16 are elevational views of an installation respectively illustrating the level of the carrying cable of a line equipped with a conventional vehicle and that of a line equipped with a vehicle according to FIGS. 13 and 14.
Figure 16:
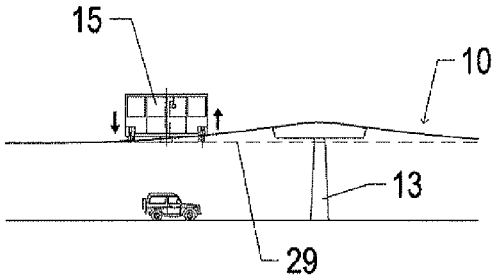

The advantage of an arrangement of the car above the cables is clearly apparent from FIGS. 15 and 16 which respectively represent a conventional installation with a hanger arm and very high pillars and an installation according to the invention.

Figure 3:
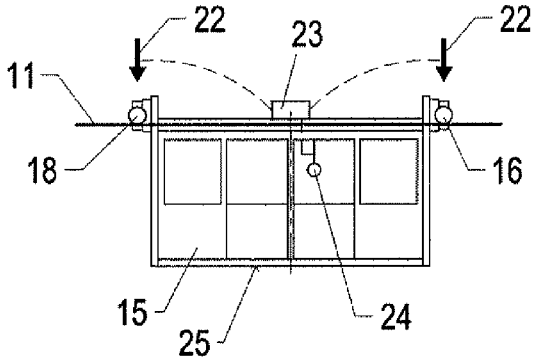
FIGS. 3 and 4 are schematic front and side views of a vehicle according to the invention.
Figure 4:
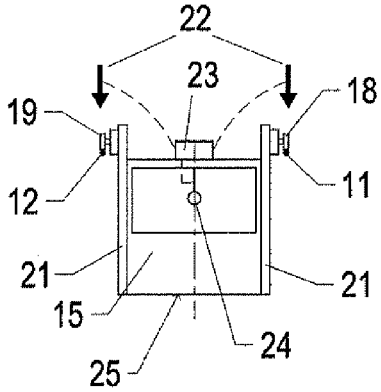
Figure 17:
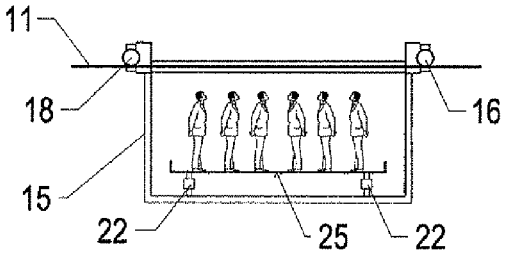
FIGS. 17 and 18 are similar views to FIGS. 3 and 4 illustrating a simplified alternative embodiment.
Figure 18:
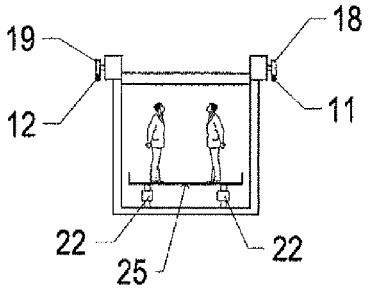

Another alternative embodiment is illustrated by FIGS. 17 and 18, which are similar views to FIGS. 3 and 4. Jacks 22 connect rollers 16-19 to the essential parts of passenger compartment 15, i.e. to floor 25 which supports the passengers. In this embodiment, the base of the passenger compartment is formed by a bottom and by a floor and the jacks are inserted between the bottom and the floor, in the manner represented in the figures. Operation is identical to that described above and this embodiment may be advantageous when the height variations remain small.

Figure 19:
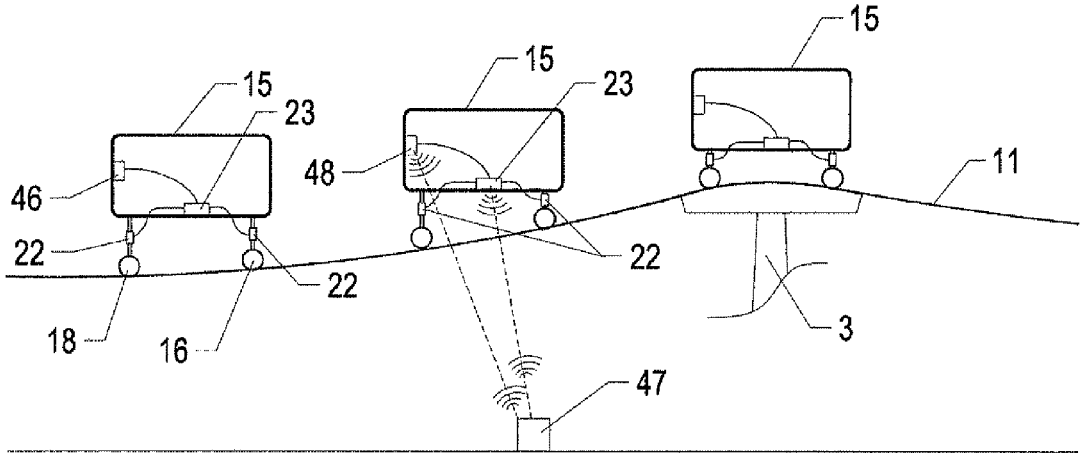
FIG. 19 is a similar view to FIG. 2 showing a trajectory correction device.

FIG. 19 is relative to a trajectory correction to reduce or compensate the vertical acceleration of the vehicle, in particular when passing over a pillar. The invention is applied to a vehicle of the type according to FIGS. 13 and 14, which should advantageously be referred to for greater details, but it is clear that the described invention is applicable to the other vehicle systems described in the foregoing. Vehicle 15 without a hanger arm runs via four rollers 16-19 on a pair of carrying cables 11, 12 that are spaced apart from one another. The rollers are located underneath vehicle 15 and a jack 22, fitted between the roller and the floor of the vehicle, is associated with each roller. Jacks 22 of the vehicle, represented on the left in the figure, are controlled by a vertical acceleration detector 46 which controls central unit 23.

Operation is easy to understand. When the cars are running on the substantially horizontal part of the track, jacks 22 are in an elongate position and they remain in this position so long as the vertical acceleration measured by detector 46 remains low. On approaching pillar 3, the variation of the slope of cables 11,12 generates an ascending vertical acceleration, detected by detector 46, which commands retraction of jacks 22 so as to remove the car towards the rollers.

The path taken by the car is not different from that of cables 11,12 and its flattened shape generates a reduced vertical acceleration. After the car has passed over the top of the shoe of pillar 3, the descending vertical acceleration generates a reverse operation which brings the jacks back into the elongate position.

In the version of the installation according to FIG. 19, the latter is advantageously improved by assigning to jacks 22 a function of maintaining the verticality of the car, described in the foregoing, in addition to the function of reducing the vertical acceleration. To this end, it suffices to provide sufficient travel of jacks 22, which are active all along the line, and to add to detector 46 a trim corrector (not represented) controlling the verticality of the car.

Another manner of controlling jacks 22 according to the invention has been represented on the vehicle in the centre of FIG. 19, in replacement of the vertical acceleration detector. A detector 47 arranged to collect data provided by an emitter 48 and concerning the cable, in particular the incline of the cable, when the vehicle passes, is fitted up-line from pillar 3, for example on the ground. Detector 47 retransmits information, partially representative of the path of the cable when passing the pillar, to central unit 23 controlling jacks 22. Depending on the installation, this information may be sufficient to control the jacks so as to reduce the vertical acceleration. The information can be specified by installing detectors 47 at several locations, and likewise by adding other sensors (not represented) to detector 47, for example detecting the heightwise position of the vehicle, which depends on the weight of the vehicle. Central unit 23 can further receive other information, such as the speed of the cable, which determine the vertical acceleration.

In FIG. 20, which is similar to FIG. 4, each carrying cable is doubled up into two parallel and juxtaposed cables 11,11' and 12,12', and each roller is doubled up into two rollers 18,18' and 19,19', juxtaposed on the same spindle to run on the corresponding cable. It can be understood that in the event of malfunctioning of one of the assemblies, for example 11-18, the juxtaposed assembly 11'-18' takes over and performs the carrying function.

FIG. 21 represents passage of a vehicle 15 from cable tracks 11,11'; 12,12' to a rail track in a terminal station 49,49'; 50,50', each cable being extended by a rail, and a gap, respectively 51,51', always remains in the junction zone between the cable and the rail due to passage of cables 11,11' diverted downwards, and 52,52' for cables 12,12'. According to the invention, gaps 51,51' are staggered longitudinally with respect to one another so that roller 11' passes over gap 51' before roller 11 passes over gap 51. In identical manner, gaps 52,52' are staggered.

It has been explained in the foregoing that the juxtaposition of the cables and that of the rollers enables one of the rollers to take over from the other in case of failure, and it can be understood that when roller 18' passes gap 51', it is roller 18 that takes over and performs supporting of vehicle 15. Likewise, when roller 18 passes gap 51, supporting is performed by roller 18'. Passage of the other gaps takes place in the same manner. Switching of the vehicle from the cables to the rails thus takes place without any jerking and switching can take place at high speed.

FIG. 22 is a similar view to FIG. 13 showing an alternative embodiment. The four rollers (16-19) are fixed to a chassis 62 and jacks 22 associated with each roller are fitted between chassis 62 and passenger compartment 15.

Figure 23:
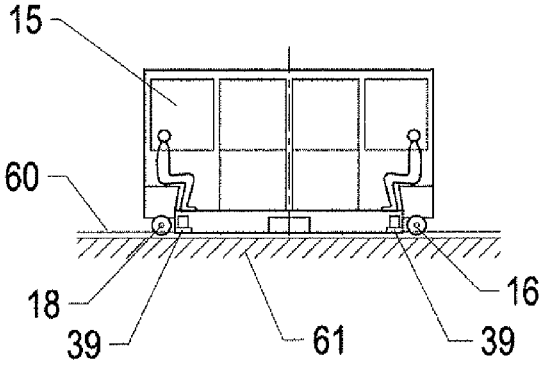
FIGS. 23 and 24 are similar views to FIGS. 13 and 14 illustrating running of a vehicle, according to the invention, in a terminal with the coupling clamps retracted.
Figure 24:
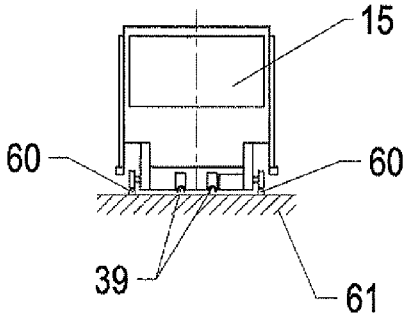

FIGS. 23 and 24 represent a vehicle 15, according to FIGS. 13,14, detached from hauling cable 38, running in a terminal station on rails 60, the coupling clamps 39 of which are retracted so as not to encroach on the ground clearance 61 of the terminal.

The invention claimed is:

1. An overhead installation for transporting people, comprising two overhead carrying cables spaced apart from one another, extending in parallel manner on the same level, being stretched taut between two pillars to form a curved running track presenting a deformable sag, and a positively guided, servo-controlled vehicle comprising a passenger compartment, four rollers arranged in the form of a rectangle, with two rollers longitudinally spaced apart from one another running on one of the cables, and two rollers longitudinally spaced apart from one another running on the other cable, to support and guide the passenger compartment of the vehicle running on the curved track, and a connecting device without a hanger arm between the rollers and the passenger compartment to position the passenger compartment longitudinally and transversely, wherein the four rollers follow the height variations of the cable in space independently, during movement of the vehicle, said connecting device comprising an individual positive height-adjustable jack for each roller, and the vehicle comprising a central unit which controls the different individual jacks so as to compensate the height variations of the different rollers, imposed by the cables, during movement on the curved track.

2. The installation according to claim 1, wherein the vehicle comprises a device for measuring the incline of the passenger compartment which controls the central unit, and the central unit controls the jacks to keep the passenger compartment horizontal.

3. The installation according to claim 1, wherein the cables are located underneath the vehicle, and the vehicle runs above the cables and comprises a detector of transverse rocking of the vehicle which controls the central unit so as to prevent any excessive transverse rocking and any sideways toppling of the vehicle.

4. The installation according to claim 3, comprising a hauling cable, underneath the vehicle, fitted between the carrying cables and a clamp for coupling to the cable fixed underneath the vehicle.

5. Installation according to claim 4, wherein the clamp for coupling to the hauling cable is retractable after it has been uncoupled from the hauling cable.

6. The installation according to claim 1, wherein the four rollers and the four associated jacks are located at the four corners of the passenger compartment, and the four jacks present a vertical displacement controlled by the central unit.

7. The installation according to claim 6, wherein the jacks are fitted between the bottom of the passenger compartment and the floor supporting the passengers.

8. The installation according to claim 1, wherein each carrying cable is doubled up into a pair of identical, juxtaposed carrying cables of reduced cross-section, extending in parallel manner to one another and subjected to the same tension, and each roller is also doubled up into a pair of rollers, the rollers of one and the same pair running on the cables of one and the same pair being fitted on the same spindle so that one of the rollers supports the vehicle in the case of malfunctioning of the other roller.

9. The installation according to claim 8, wherein each track constituted by the juxtaposed carrying cables is connected to a track with fixed rails, each rail extending one of the cables with a gap between the end of the cable and that of the rail, and the gaps are longitudinally staggered with respect to one another.

10. The installation according to claim 1, wherein the vehicle comprises a device for measuring the vertical acceleration which controls the central unit to command a reduction of the length of the jacks when an ascending vertical acceleration takes place, and to subsequently command an elongation when a descending vertical acceleration takes place, in particular after having passed over the pillar.

11. The installation according to claim 1, wherein a detector, placed at a specific point up-line from the pillar, receives specific information conditioning the vertical acceleration when passing over the pillar, from an emitter carried by the vehicle, when passing this point, the information being transmitted by the detector to the central unit which controls the jacks to reduce the vertical acceleration.

12. The installation according to claim 1, wherein the vehicle comprises a detector of the variation of the height of the vehicle which controls the central unit, which unit commands the individual jacks simultaneously and by the same value to keep the level of the vehicle constant in particular when passing over the pillars.

13. The installation according to claim 1, wherein the vehicle comprises rollers fixed to a chassis and the jacks associated with each roller are fitted between the chassis and the passenger compartment.

14. The installation according to claim 1, wherein the vehicle comprises one or more electric motors driving one or more rollers.

* * * * *